United States Patent [19]

Murphy et al.

[11] 4,237,081

[45] Dec. 2, 1980

[54] METHOD FOR PREPARATION OF FIBRILS

[75] Inventors: Clarence R. Murphy, Houston, Tex.; Robert E. Boehme, deceased, late of Houston, Tex.; by Helen J. Boehme, legal representative, Kalamazoo, Mich.; by Joseph P. Phelp, executor, Norristown, Pa.

[73] Assignee: Gulf Oil Corporation, Pittsburgh, Pa.

[21] Appl. No.: 892,799

[22] Filed: Apr. 3, 1978

[51] Int. Cl.³ ..... C08G 51/21; B24D 3/00

[52] U.S. Cl. ..... 264/9; 162/157 R; 264/140

[58] Field of Search ..... 264/140, 14, 11, 9; 162/157 R

[56] References Cited

U.S. PATENT DOCUMENTS

| | | | |
|---|---|---|---|
| 1,993,762 | 3/1935 | Tolmo | 366/162 |
| 3,414,640 | 12/1968 | Gavetto et al. | 264/14 |
| 3,529,936 | 9/1970 | Muller-Rid et al. | 264/14 |
| 4,013,751 | 3/1977 | Davis et al. | 162/157 R |
| 4,091,058 | 5/1978 | Sander et al. . | |
| 4,104,341 | 8/1978 | Keppler et al. | 264/140 |
| 4,125,584 | 11/1978 | Boehme et al. | 11/9 |
| 4,138,315 | 2/1979 | Sander et al. | 162/157 R |

*Primary Examiner*—Jay H. Woo

*Attorney, Agent, or Firm*—Richard L. Kelly

[57] ABSTRACT

Apparatus useful in the manufacture of thermoplastic Olefin polymer fibrils are prepared by a process carried out in a disc mill. A hot olefin polymer solution is fed into the working cavity defined by the discs. In passing through the working cavity, the hot polymer solution is broken up into a plurality of uniaxially-oriented liquid streams which follow tortuous liquid paths through the working cavity whereby each of the streams is attenuated to orient the solute polymer molecules in said streams. A coolant liquid is fed into the working cavity and cools the attenuated polymer streams to a temperature sufficiently low so that substantially all of the solute polymer is precipitated in the form of uniaxially-oriented polymer fibrils. The product recovered from the modified disc mill consists of a mixture of uniaxially-oriented polymer fibrils, polymer solvent, and coolant liquid. The fibrils are recovered and refined in subsequent downstream operations.

6 Claims, 8 Drawing Figures

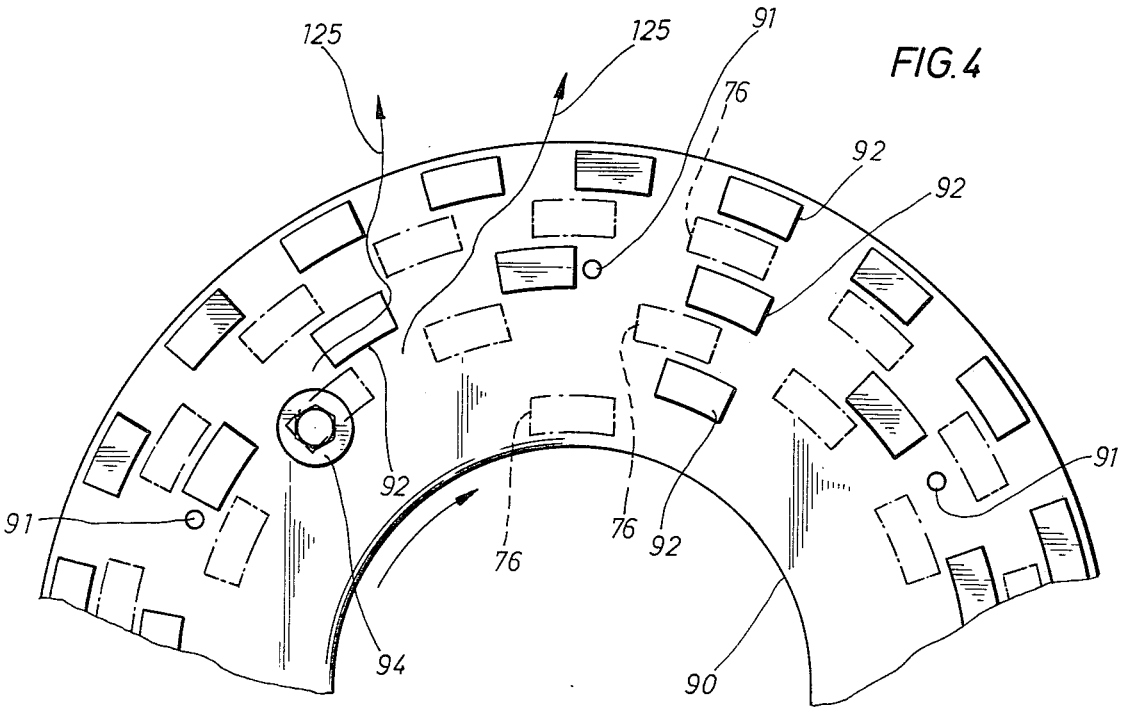
FIG. 4
FIG. 5A
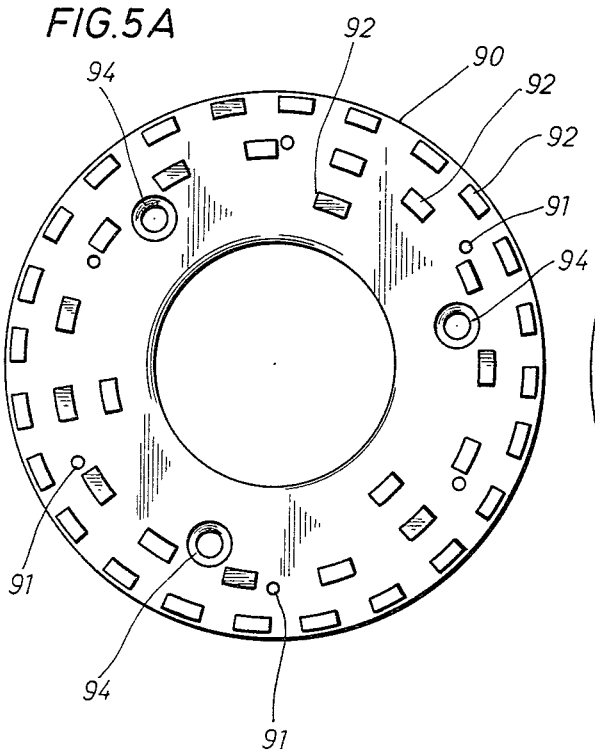
FIG. 5B
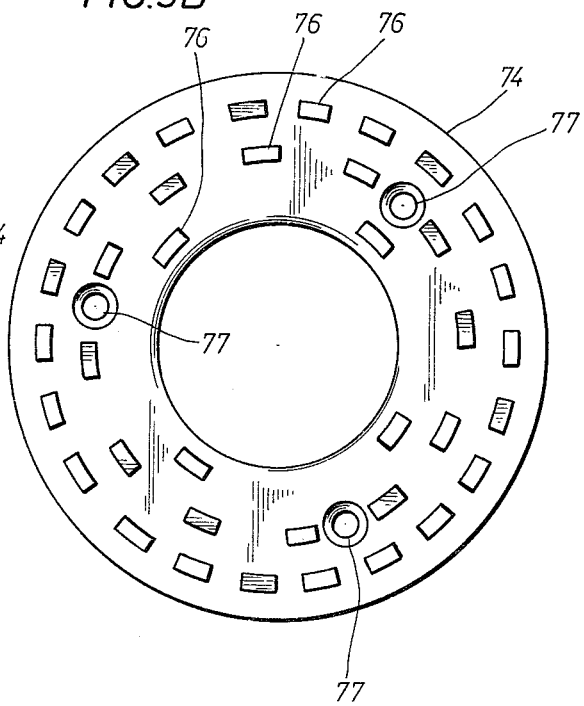

METHOD FOR PREPARATION OF FIBRILS

BACKGROUND OF THE INVENTION

Processes for the manufacture of fibrils by orienting thin streams of polymer solutions and precipitating the polymer therefrom are known in the art. See U.S. Pat. Nos. 2,988,782; 2,999,788; and 4,013,751. All of the processes known in the art are deficient in one or more respects. Certain of the processes precipitate the solute polymer before it is fully oriented and, as a consequence, the fibrils do not develop their ultimate potential strength. Other of the processes have a high capital cost or low productivity, or both. The literature reported processes also are subject to the shortcoming that few if any variations can be made in the zone in which the polymer is being precipitated. As a consequence, few if any modifications can be made in the physical properties of the fibrils being produced.

There is a need in the art for an improved fibril manufacturing process which will (1) provide fibrils of high strength, (2) have low manufacturing costs, and (3) have the capability of significantly modifying the physical properties of the fibrils being produced in the process.

SUMMARY OF THE INVENTION

Novel apparatus and a novel process are provided for the manufacture of fibrils. The apparatus provided by the invention is a modified disc mill consisting essentially of:

(a) a stationary disc, (b) a rotatable disc whose annulus is positioned in close proximity to the annulus of the stationary disc so as to define a working cavity therebetween, (c) a plurality of juxtapositioned protuberances on the working faces of the two discs so that, when the rotatable disc is rotated, a liquid passing through the working cavity will be forced through a plurality of tortuous paths and subjected to a shearing action, (d) a central liquid reservoir defined by the center sections of the two discs, (e) a first liquid feed inlet in the stationary disc which empties into the central liquid reservoir, (f) a second liquid feed inlet in the stationary disc which empties into the working cavity, and (g) means for rotating the rotatable disc.

The process of the invention consists of feeding a hot viscous olefin polymer solution into the central liquid reservoir of the apparatus and rotating the rotatable disc of the apparatus so as to feed the hot polymer solution from the central liquid reservoir into the working cavity provided between the annuluses of the working discs. By reason of the arrangement of the protuberances on the disc faces, in passing through the working cavity, the olefin polymer solution is broken up into a plurality of uniaxially-oriented streams and attenuated to uniaxially orient the solute olefin polymer molecules in said streams. A coolant liquid is fed into the working cavity so as to cool the olefin polymer solution streams to a temperature sufficiently low so that substantially all of the solute olefin polymer is precipitated in the form of uniaxially-oriented olefin polymer fibrils. The discharge from the disc mill is a mixture of uniaxially-oriented olefin polymer fibrils, olefin polymer solvent, and coolant liquid from which the fibrils are separated and recovered. The fibrils as thus recovered then are subjected to further downstream refining operations.

BRIEF DESCRIPTION OF THE DRAWINGS

FIG. 4 is a view taken through lines 4—4 of FIG. 3.

FIG. 5A is a plan view of disc 90 employed in the apparatus of FIG. 2.

FIG. 5B is a plan view of disc 74 employed in the apparatus of FIG. 2.

DETAILED DESCRIPTION OF INVENTION

Figure 1:
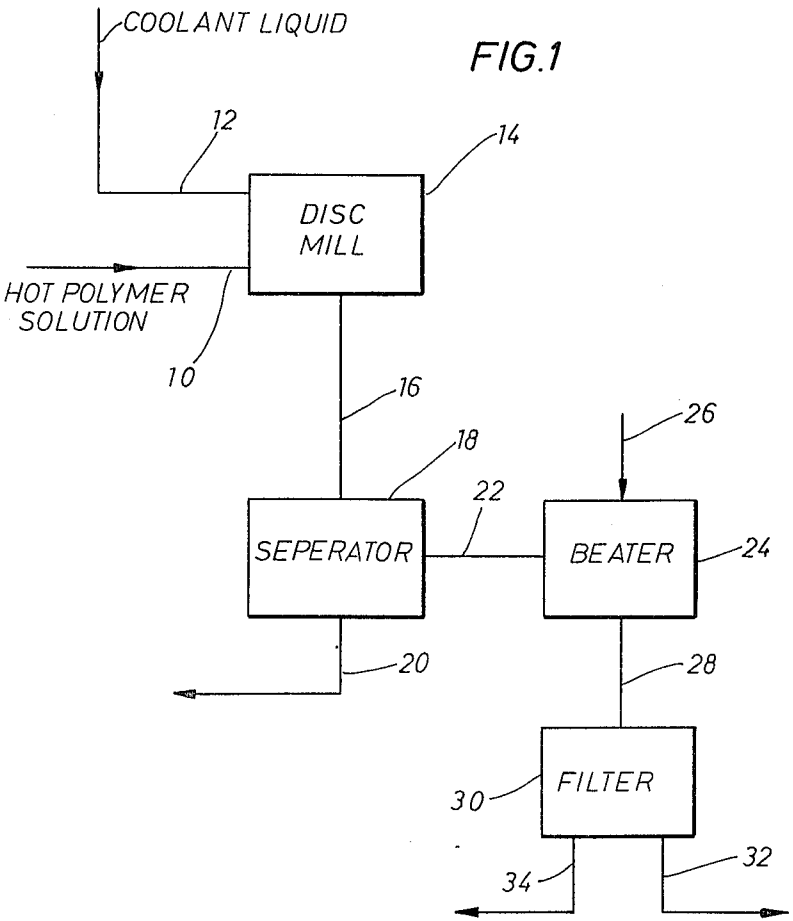
FIG. 1 is a flow diagram showing the process steps of the invention.

FIG. 1 illustrates the overall process of the invention. A hot solution of an olefin polymer, such as linear polyethylene, having a number average molecular weight of at least 1 million dissolved in a suitable solvent such as kerosene is fed through line 10 to a modified disc mill 14. A coolant liquid such as water is fed through line 12 to the disc mill. While within disc mill 14, by an action which will be subsequently described, the hot polymer solution is converted into a mass of solvent swollen polymer fibrils. The polymer fibrils and associated liquids leave the disc mill by exit line 16.

The solvent swollen fibrils and associated solvent and coolant liquids are fed by outlet line 16 to a separator 18. Within separator 18 the solvent swollen fibrils are separated from most of its associated liquids such as solvent and coolant, which may be the same. The separation may be accomplished by a squeezing or pressing action on the fibrous mass, and may be preceded either within or without separator 18 by a filtering operation wherein the bulk of the liquids are separated from the fibrils. The separated liquids exit separator 18 through line 20 and are recycled. The fibrils are removed from separator 18 through line 22.

The swollen fibrils proceed through line 22 into a beater 24 or other like refiner for further treatment. An alcohol, such as isopropanol when employing polyethylene as the polymer from which the fibrils are produced, is directed into beater 24 through isopropanol feed line 26 to aid in further treating, refining, and removing of solvent from the fibrils. In addition to aiding in the removal of solvent from the fibrils, the alcohol acts as the suspending medium for the fibrils within beater 24. Beater 24 may be a blender, disc refiner or other like beating and refining apparatus. The beating carried out within beater 40 should be continued for a time sufficient to break down the solvent swollen fibrous mass into a plurality of individual fibrils.

For a final or concluding step of the process, the product of the beater consisting of fibrils, the alcohol or other suspending and refining medium, and to an extent the solvent used in dissolving the polymer is discharged from beater 24 through outlet line 28 and directed into a filter 30 for a final separation or filtration step. After the separation or filtration step, the product of the process exits filter 30 through solids outlet 32, this being the improved fibril of the invention. Also exiting filter 32 through a liquids outlet 34 is a combination of alcohol or other like suspending medium and a certain but smaller amount of the solvent used in the system.

In a preferred embodiment of the invention, the fibrils as recovered above will be further refined with an aqueous solution of polyvinyl alcohol. This treatment displaces the alcohol with water and coats the fibrils with a thin film of polyvinyl alcohol. For reasons not fully understood, the fibrils treated in this manner, when examined under a microscope, appear to have a combination of film and fiber morphology.

Figure 3:
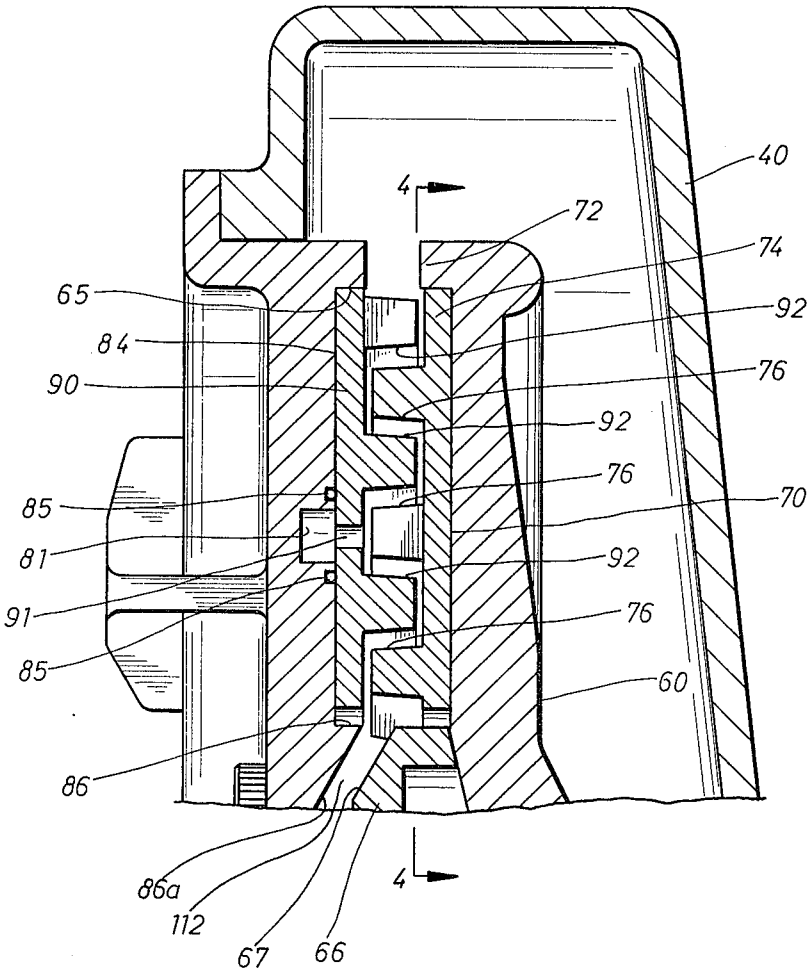
FIG. 3 is an enlarged view, partially in section, showing the manner in which the protuberances of the discs mesh to define a working cavity therebetween.
Figure 2:
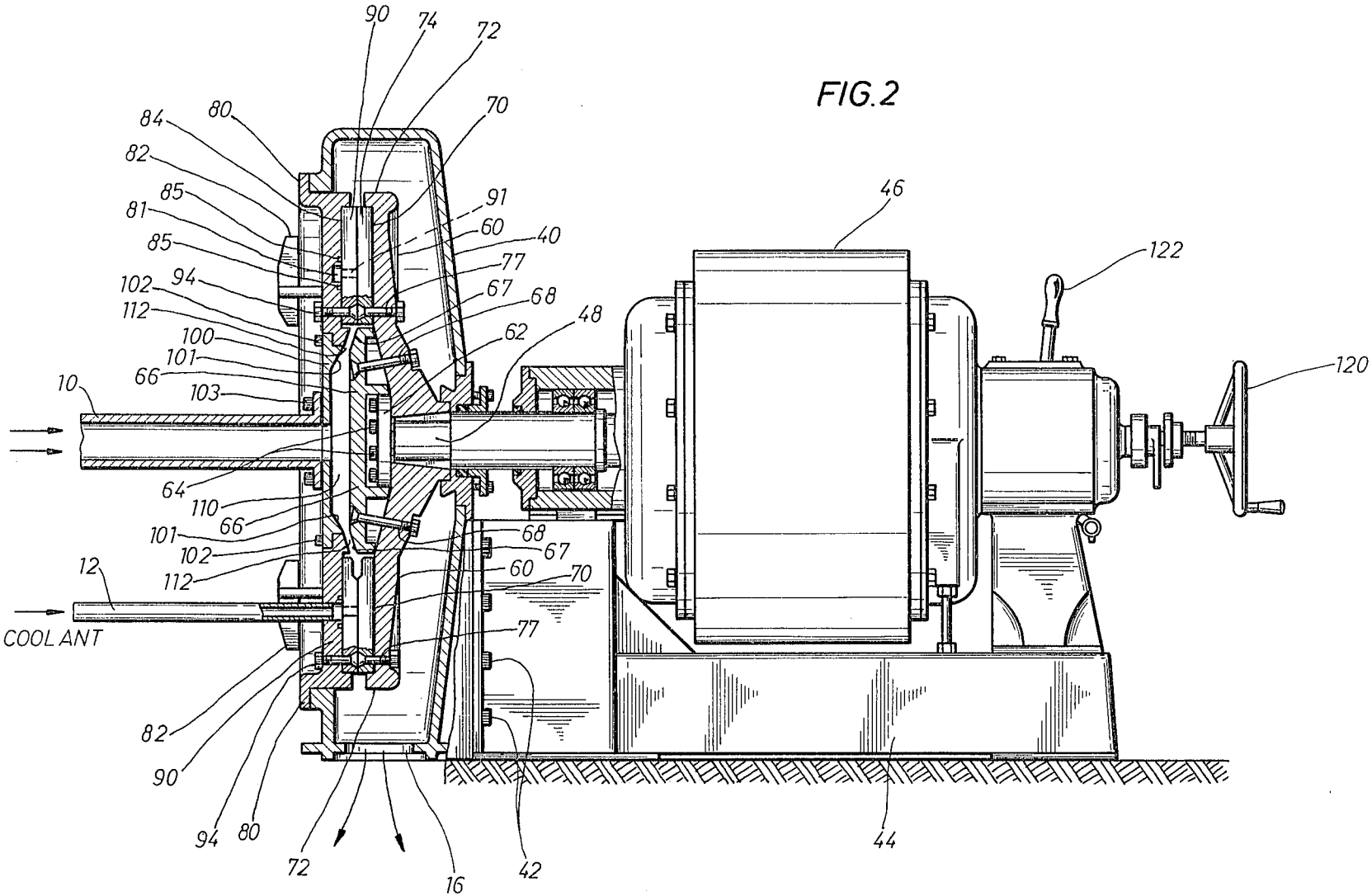
FIG. 2 is a side elevation view of the apparatus of the invention partially in section.

FIGS. 2 and 3 illustrate a disc mill which is a modification of a No. 148-2-8" disc mill supplied by C. E. Bauer of Springfield, Ohio. The mill 14 includes a housing member 40 which has a discharge orifice 16 and which is attached to a massive base 44 by means of fastening members 42. A motor 46 is mounted on base 44 and drives a shaft 48 which powers the mill. A plate 60 having the general shape of an inverted pie pan is mounted on shaft 48 and is attached firmly thereto by suitable keys not shown. A sealing plate 62 is attached to plate 60 by fastening members 64 and serves as a seal to prevent materials fed into the mill from contacting shaft 48. A larger plate member 66 having a tapered shoulder 67 is attached to plate 60 by fastening members 68. Plate 66 has a flat machined surface 70 and a raised shoulder 72 which together define a seat for an annular disc 74. Disc 74 has a series of regularly spaced protuberances 76 projecting from its working face and is attached to plate 60 by fastening means 77. Disc 74 corresponds in construction to plate member 8819 supplied by C. E. Bauer.

A fixed plate 80, provided with a cut out in its center, fits into the opening of housing 40. Plate 80 is mounted on hinges 82 and serves as a door to provide access to the interior of mill 14. A flat surface 84 is machined in the face of plate 80 and together with shoulders 85 and 86 defines a seat for an annular disc 90. Disc 90 is similar in construction to plate member 8818 supplied by C. E. Bauer. The disc 90 is fastened into its seat by fastening members 94. Shoulder 86 has a tapered face 86*a* whose function will be described subsequently. A series of regularly spaced protuberances 92 project from the surface of disc 90 and mesh with protuberances 76 of disc 74. A center plate 100, which has tapered face 101, is attached to plate 80 by fastening members 102. Liquid feed inlet 10 is attached to center plate 100 by fastening members 103.

The faces of plate 66 and plate 100 define a central liquid reservoir 110. A narrow orifice 112, defined by shoulders 67, 86*a*, and 101, provides a liquid conduit between the central liquid reservoir 110 and the liquid cavity defined by discs 74 and 90.

An annular groove 81 is machined in the face of plate 80. A pair of narrower grooves are machined in plate 80 to accept a pair of "O" rings 85 so that, when disc 90 is positioned against face 84, groove 81 defines a fluid tight conduit. Line 12 is tapped into plate 80 to feed fluid to conduit 81. A series of orifices 91 (See FIGS. 4 and 5A) are provided in disc 90 so that fluid from conduit 81 can be fed into the liquid cavity defined by discs 74 and 90.

While discs 74 and 90 can be manufactured with sufficient precision to provide the desired clearance between the discs, it is desirable to provide means for making adjustments in the gap spacing between the discs. A manually-operated hand wheel 120 is provided to make such spacing adjustments. A quick release mechanism including a lever 122 is provided for quickly separating the discs when required.

In operation of the invention, a polymer solution, consisting of about 4 weight % of a high molecular weight linear ethylene polymer having a number average molecular weight of at least 1 million dissolved in a kerosene-type of hydrocarbon, heated to a temperature of about 190° C., is fed through line 10 into the central liquid reservoir 110 provided in the modified disc mill. The rotatable disc is rotated at high speed, typically at least 1000 rpm, so that the centrifugal force imposed on the polymer solution by plate 66 forces the polymer solution through the orifice 112 into the entire annual working cavity defined by discs 74 and 90. The polymer solution is pumped into the central liquid reservoir at such a rate that it remains fluid full at all times.

Upon entering the cavity defined by discs 74 and 90, the hot polymer solution is subjected to intense shearing forces. This results from a combination of factors. For one, the volume of free space in the cavity is quite small by reason of the close spacing between discs 74 and 90 and the substantial percentage of such volume that is occupied by protuberances 76 and 92. For another, the angular velocity of the surface of disc 74 increases regularly along its radial axis, i.e., the distance of any surface point from the center axis of shaft 48. As a result of the complex forces on the olefin polymer solution in the working cavity, the polymer solution, in passing through the working cavity, is broken up into a plurality of uniaxially-oriented streams which follow a plurality of tortuous liquid paths which go over and around the fixed protuberances 92 of fixed plate 90. The arrows 125 in FIG. 4 show typical paths that the polymer solution can take. The shearing forces orient the polymer molecules in the polymer solution.

While the hot polymer solution is being oriented as described above, a cooling liquid such as water is pumped into channel 81 of plate 80 and enters into the working cavity via orifices 91 provided in fixed disc 90. The coolant liquid, like the hot polymer solution, follows a plurality of paths in passing through the working cavity. The coolant liquid contacts the hot polymer streams and rapidly cools them so that the solute polymer is precipitated as thin strands in a highly-oriented state. The quantity of coolant liquid employed will depend upon a multiplicity of factors. In most instances, the coolant liquid will be employed in a quantity well in excess of the polymer solution on a weight basis. By reason of their narrow thickness and frailty, these strands are readily broken and are recovered as fine fibrils. When prepared under optimum conditions, a majority of the fibrils will have lengths of the order of 1–5 mm and diameters of the order of 5 to 100 microns. Typically the recovered fibrils will have a surface area of greater than 50 $m^2$/gram.

Figure 6A:
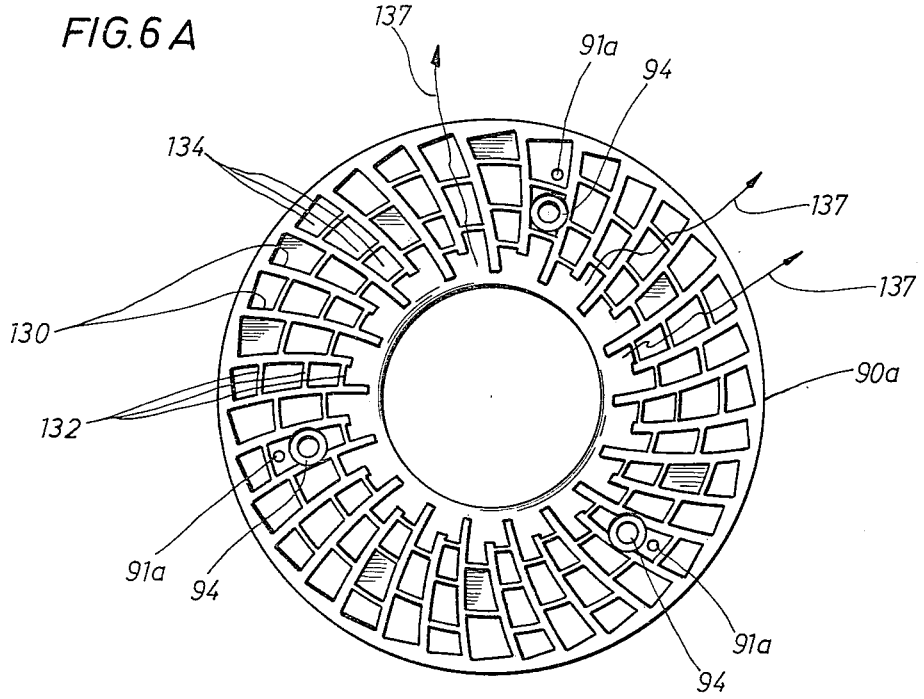
FIGS. 6A and 6B are plan views of another set of discs which can be employed in the apparatus of the invention.

FIG. 6A illustrates a modified fixed disc 90*a* which can be used in lieu of disc 90 and is designed for use with modified rotating disc 74*a*. Disc 90*a* is similar in construction to plate number 8504 supplied by C. E. Bauer. Disc 90*a* has entry orifices 91*a* and a plurality of generally radially aligned ribs 130. A series of cross members 132 are provided between each pair of ribs 130. Cross members 132 are shorter in height than ribs 130 and subdivide the space between ribs 130 into a series of shallow compartments 134.

Figure 6B:
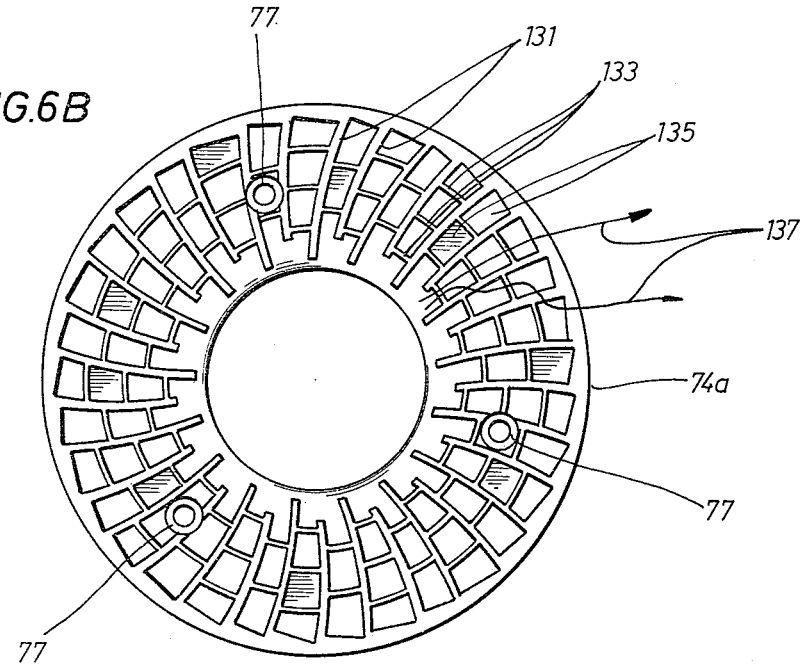

FIG. 6B illustrates a modified rotating disc to be used with disc 90*a*. Disc 74*a* has a plurality of generally radially-aligned ribs 131 which are connected by cross members 133 which subdivide the space between ribs 131 into a number of shallow compartments 135. Disc 74a corresponds in construction to plate member 8505 supplied by C. E. Bauer.

This cooperative pair of discs 74a and 90a imposes very high shear on the hot polymer solution which is passed through the working cavity defined therebetween. By reason of the presence of the cross members 132 and 133 which define the shallow compartments 134 and 135, the polymer solution flows over the various cross members and ribs of discs 74a and 90a in a plurality of tortuous paths. Certain typical flow patterns are shown by arrows 137.

From the above discussions, it is readily seen that significant modifications can be made in the precipitating and shearing conditions operating within the working cavity defined by the working discs. The rate at which polymer solution is pumped into central liquid reservoir, the rotational speed of the rotating disc, and the spacing between the discs control the rate at which polymer solution is forced into the working cavity. The rational speed of the rotating disc, the spacing between the discs, and the geometry of the discs faces all have a significant effect upon the shearing forces developed within the working cavity. The ratio of coolant liquid to polymer solution fed to the working cavity controls the temperature at which the solute polymer is precipitated. By suitable control of these factors, it is possible to prepare fibrils ranging from extremely fine fibrils having typical lengths of 1.3 mm and diameters of 25 microns to relatively coarse fibrils having typical lengths of 3.5 mm and diameters of 100 microns.

In the preferred embodiment of the process of the invention, the liquid coolant is fed directly into the working cavity defined by the two discs. When the coolant liquid is immiscible with the polymer solution, e.g., water, the coolant can be fed into the central liquid reservoir of the mill with the olefin polymer solution. By reason of the short residence time of the polymer solution in the central liquid reservoir and its limited physical contact with the coolant liquid (by reason of their immiscibility), little or no precipitation of the olefin polymer occurs until the polymer solution enters into the mill's working cavity.

The following examples are set forth to illustrate more clearly the principle and practice of the invention to those skilled in the art. Where parts and percentages are mentioned, they are parts and percentages on a weight basis unless otherwise noted.

Three types of fibrils made by prior art processes were obtained for use as controls to be compared with fibrils made by the present invention. Control A was a lot of polyethylene fibrils sold by Crown-Zellerbach. Control B was a lot of polyethylene fibrils sold by Solvay & Cie. Control C was prepared as described in Example 1 of U.S. Pat. No. 4,013,751 with the isopropanol-wet fibrils being treated with an aqueous solution of polyvinyl alcohol as described in U.S. Pat. No. 4,049,493 before drying.

EXAMPLE 1

Part A

A lot of fibrils was prepared employing the apparatus illustrated in FIG. 2, except that fixed plate 90 was replaced with plate 90a illustrated in FIG. 6A and rotating plate 74 was replaced with plate 74a illustrated in FIG. 6B. The mill employed with a No. 148-2-8" manufactured by C. E. Bauer of Springfield, Ohio. Plate 90a was plate number 8504 and plate 74a was plate number 8505, both supplied by C. E. Bauer. The spacing between the faces of ribs 130 of plate 90a and the faces of ribs 131 of plate 74a was set at 0.006". A polymer solution containing 2 weight % of an ethylene homopolymer having a number average molecular weight of about 1.5 million was dissolved in kerosene and heated to a temperature of about 200° C. was fed to the mill at a rate of about 0.6 gallon/minute. Simultaneously cooling water at ambient temperature was fed to the mill at a rate of about 2.5 gallons/minute. The rotating disc was rotated at a speed of 1350 rpm.

The mixture of fibrils, solvent and water recovered from exit port 16 was filtered to recover the fibrils which were wet with the kerosene solvent. One part of the fibrils was mixed with 99 parts of commercial grade isopropanol and stirred for 120 seconds in a Waring Blendor. The fibrils were recovered by filtration and this operation was repeated two times. One part of the fibrils then was mixed with 99 parts of a 0.1 weight % solution of polyvinyl alcohol (Vinol 540) and stirred for 60 seconds in a Waring Blendor. After filtering, the fibrils (one part) were washed with 99 parts of water for 60 seconds in the Waring Blendor. The fibrils then were washed for a second time with water for 30 seconds in the Waring Blendor.

At the conclusion of the run, it was observed that some plugging of the plates had occurred. In addition, it was noted that the recovered fibrils were quite short and extremely fine in diameter. These factors suggest that optimum processing conditions were not employed.

Part B

Hand sheets were prepared from the fibrils of Part A and Controls A, B, and C. Mullen Burst Strength in psi, Tear in g/sheet, Tensile strength in psi, Elongation in %, and Opacity values were measured employing TAPPI procedures. All measured values were divided by the sheet's basis weight to give factored values. The results are shown in Table I.

TABLE I

| Sample | Example 1 | Control A | Control B | Control C |
|---|---|---|---|---|
| Basis Weight | 62.2 | 56.0 | 57.4 | 58.8 |
| Mullen Burst, psi | 30 | 3.5 | 4.0 | 49.9 |
| Tear, g/sheet | 137 | 8.9 | 11.2 | 240 |
| Tensile, psi | 10 | 0.5 | 1.0 | 17.0 |
| Elongation, % | 57.4 | 3.8 | 4.4 | 78.6 |
| Opacity | 93.7 | 95 | 96 | 87.2 |

The above results show that the product of Example 1 has an opacity equivalent to the three controls. The product is superior to the two commercial polyethylene fibrils (Controls A & B) in strength as measured by Mullen-Burst, Tear and Tensile properties. The experimental product was inferior to Control C in strength.

The sheets prepared from the product of Example 1 were very smooth and had a fine texture. They also had a very low porosity.

EXAMPLE 2

Example 1, Part A, was repeated except that the speed of the rotating disc was increased to 3,000 rpm. Two differences in results were noted. First, there was no evidence of any plugging of the plates. Second, the fibrils were extremely short and very fine in diameter. By reason of their fine size, it was difficult to make hand sheets for evaluation.

EXAMPLES 3 and 4

Two additional batches of fibrils were made employing the general procedure of Example 1, Part A. In Example 3, the speed of the rotating disc was set at 3,000 rpm with the spacing between the plates being increased to 0.014". Example 4 was identical to Example 3 except that the spacing between the plates was set at 0.010". Hand sheets were prepared with the data being set forth in Table II.

TABLE II

| Sample | Example 3 | Example 4 | Control A | Control B | Control C |
|---|---|---|---|---|---|
| Basis Weight | 63.1 | 64.5 | 56.0 | 57.4 | 58.8 |
| Mullen Burst, psi | 55.1 | 56.2 | 3.5 | 4.0 | 49.9 |
| Tear, g/sheet | 301 | 290 | 8.9 | 11.2 | 240 |
| Tensile, psi | 19.7 | 21.2 | 0.5 | 1.0 | 17.0 |
| Elongation, % | 141 | 143 | 3.8 | 4.4 | 78.6 |
| Opacity | 89.1 | 89.1 | 95 | 96 | 87.2 |

In comparing the data for Examples 3 and 4 with Example 1 (see Table I), the fibrils of these Examples gave sheets having superior strength, measured by Mullen Burst, Tear, and Tensile. Moreover, the sheets prepared from the fibrils of these examples were superior to the fibrils of Control C, and much superior to the fibrils of Controls A and B.

The sheets prepared from Example 3 were relatively coarse and porous. The sheets prepared from Example 4 were intermediate between the sheets of Examples 1 and 3 with respect to texture and porosity.

EXAMPLES 5, 6, and 7

Three lots of fibrils were made employing the conditions of Example 4. except that the feed rate of water coolant was varied while holding the rate of olefin polymer solution constant at 0.5 gallon/minute. The coolant rates were, respectively, 2.5 gallon/minute in Example 5, 1.75 gallon/minute in Example 6, and 1.3 gallon/minute in Example 7. Lowering the rate of coolant feed increased the temperature in the working cavity. The physical properties of hand sheets prepared from the fibrils are set forth in Table III.

TABLE III

| Sample | Example 5 | Example 6 | Example 7 |
|---|---|---|---|
| Basis Weight | 60.5 | 55.8 | 60.1 |
| Mullen Burst, psi | 61 | 66.7 | 68.3 |
| Tear g/sheet | 254 | 267 | 231 |
| Tensile, psi | 22.6 | 23.3 | 26.3 |
| Elongation, % | 143 | 136 | 137 |
| Opacity | 86.2 | 89.9 | 85.5 |

The Mullen Burst and Tensile values increased with the temperature in the working cavity. The Tear values were somewhat erratic, but equaled the values obtained with Control C shown in Tables I and II.

The process of the invention can be employed to prepare fibrils from essentially any polymer solution in which the difference in polymer solubility between the two operating temperatures is sufficiently large. The quality of the fibrils produced, of course, will be importantly influenced by the polymer from which they are prepared.

Fibrils of optimum properties are prepared from olefin polymers having a very high molecular weight such that the polymer has an intrinsic viscosity of at least 3.5, preferably at least 5.0, and especially at least 10.0. Typically, these polymers have a molecular weight of at least 1 million and preferably at least 1.5 million. Such polymers frequently are characterized as ultrahigh molecular weight olefin polymers. One species of such polymers consists of ethylene polymers containing, on a weight basis, at least 90% of polymerized ethylene. Such ethylene polymers will be ethylene homopolymers or ethylene copolymers containing small quantities of a $C_4$ or higher olefin comonomer such as butene, hexene, styrene, a conjugated diene such as butadiene, or the like. A second species of such olefin polymers consists of propylene polymers containing, on a weight basis, at least 50% of polymerized propylene. Such propylene polymers will be propylene homopolymers, or propylene copolymers containing up to 50% of copolymerized ethylene. A listing of suitable olefin polymers is set forth in U.S. Pat. No. 4,013,751, which description is incorporated herein by reference.

In the preparation of the fibrils of this invention, fibrils having a highly satisfactory combination of overall properties are obtained when the polymer employed in the process consists entirely of an olefin polymer as described above. It has been observed, however, that fibrils of generally satisfactory properties can be obtained when a mixture of polymers as described above, constitutes at least about 20 weight % and preferably at least 35 weight % of the total polymer employed in the fibril-manufacturing process.

Where polymers other than an olefin polymer, as described above, are employed as a part of the polymer used in the fibril-manufacturing process, the other polymers employed may be employed for either of two principal purposes. For one, such other polymers can be employed principally to lower the raw material cost of the fibrils to be prepared. In some cases, such other polymers can be employed to modify specific properties of the fibrils themselves, or the waterlaid, paper-like sheets prepared therefrom. Regardless of the purpose for which such other polymers are employed, for convenience of description, the polymers employed in the fibril-manufacturing process, in addition to the olefin polymers described above, will be referred to as "diluent polymers." Diluent polymers suitable for this purpose are those set forth in U.S. Pat. No. 4,013,751.

The solvent to be employed in the process of the invention can be any liquid which will completely dissolve the olefin polymer employed in the process at an elevated temperature. It is highly desirable that the solvent employed have a significantly different capacity to dissolve the olefin polymer at different temperatures. The ideal solvents are those having a very low solubility for the olefin polymer at ambient temperature, but having a high degree of solvent power for the olefin polymer at temperatures above 100° C. Hydrocarbon solvents such as kerosene, mineral spirits, tetraline and aromatic hydrocarbons such as xylenes, have excellent characteristics for use in the invention and are the preferred solvents to be employed in the invention. Other solvents, however, such as certain of the chlorinated hydrocarbons, also can be employed if desired. The solvents employed should be liquids at ambient temperature and preferably should have atmospheric boiling points above 150° C. and preferably above 180° C.

The polymer solutions employed in the process should be heated to temperatures of at least 100° C. and preferably 180° C. or higher. Polymer concentrations of 2 weight % or higher should be employed. The limiting factor in the polymer concentration that can be employed in the process is the viscosity of the polymer solution at the operating temperatures employed in the process.

The coolant liquid employed in the process can be of essentially any chemical type, but desirably should have a relatively high specific heat and should have an atmospheric boiling point above about 80° C. The solvent employed in the process also can be employed as the coolant. The use of the solvent as the coolant simplifies the recovery and recycling of the solvent. If a different coolant liquid is employed, the liquid coolant recovered from the fibrils produced will have to be recovered and separated from the polymer solvent before being recycled to the process. Water is an excellent coolant to be used for this purpose since, on standing, the solvent and water will separate for easy recovery and recycling. The coolant should be used in quantities sufficient to cool the polymer solution to a temperature sufficiently low so that essentially all of the solute polymer sprecipitates from the polymer solution. In most cases, the coolant should be employed, on a weight basis, in excess of the polymer solution.

By reason of the process by which the fibrils of the invention are prepared, it is possible to make many modifications of the fibrils which improve their utility in the manufacture of waterlaid sheets. By way of example, certain inorganic pigments, fillers, and the like can be incorporated into the polymer solution and remain physically encapsulated within the polymer filaments when they are precipitated from the fine polymer streams in the cooling step. Typical of the pigments that can be employed for this purpose include titanium dioxide, silica, calcium carbonate, calcium sulfate, and the like. In other variation of the invention, cellulosic papermaking fibers can be incorporated into the polymer solution and are encapsulated within the monofilaments in the cooling step. Waterlaid sheets prepared from such modified fibrils have enhanced opacity, improved printing characteristics, high water resistance, and the like.

What is claimed is:

1. A process for the continuous manufacture of olefin polymer fibrils in a disc mill provided with one stationary disc and one rotatable disc, each of which carries a plurality of protuberances on its working face, said discs being closely positioned to each other to define an annular working cavity therebetween, said mill being further provided with a central liquid reservoir adapted to feed liquid to the annular working cavity, said process consisting essentially of:

a. Feeding a hot viscous olefin polymer solution into said central liquid reservoir;

b. Maintaining the temperature in said central liquid reservoir sufficiently high to maintain substantially all of the olefin polymer in solution;

c. Rotating said rotatable disc so as to feed hot olefin polymer solution from said central reservoir into said working cavity and through a plurality of tortuous liquid paths defined by the protuberances of the disc faces whereby the olefin polymer solution is broken up into a plurality of uniaxially oriented streams and attenuated to uniaxially orient the solute olefin polymer molecules in said streams;

d. Feeding sufficient coolant liquid into said working cavity to cool the olefin polymer solution to a temperature sufficiently low so that substantially all of the solute olefin polymer is precipitated in the form of uniaxially oriented olefin polymer fibrils;

e. Discharging from said working cavity a mixture of uniaxially oriented olefin polymer fibrils, olefin polymer solvent, and coolant liquid; and f. Recovering the olefin polymer fibrils from the mixture discharged in step (e);

the olefin polymer solution employed in step (a) being at a temperature of at least 100° C. and having a viscosity of at least 50 centipoises; said olefin polymer having an intrinsic viscosity of at least 3.5 and being selected from the group consisting of:

a. An olefin polymer selected from the group consisting of:

(1) an ethylene homopolymer, (2) a copolymer containing at least 90 weight % of polymerized ethylene and the balance a polymerized olefin hydrocarbon containing at least 4 carbon atoms, (3) a propylene homopolymer, and (4) a copolymer containing at least 50 weight % of polymerized propylene and the balance polymerized ethylene;

b. A mixture of olefin polymers of (a), and c. A mixture of polymers containing at least 20 weight % of an olefin polymer of (a) and up to 80 weight % of a diluent polymer that is soluble at 100° C. in the solvent employed in step (a);

the solvent included in the polymer solution employed in step (a) being a hydrocarbon or a chlorinated hydrocarbon, being a liquid at ambient temperature and having an atmospheric boiling point of at least about 150° C.; and the coolant liquid employed in step (d) being water or the solvent included in the polymer solution employed in step (a).

2. The process of claim 1 in which the olefin polymer employed is an ethylene polymer.

3. The process of claim 2 in which coolant liquid employed is water.

4. The process of claim 1 in which the coolant liquid is fed directly into annular working cavity.

5. The process of claim 4 in which the olefin polymer employed is an ethylene polymer.

6. The process of claim 5 in which the coolant liquid employed is water.

* * * * *